US009549862B2

(12) United States Patent
Plotnizky et al.

(10) Patent No.: US 9,549,862 B2
(45) Date of Patent: Jan. 24, 2017

(54) WHEELCHAIR FOOT SUPPORT

(71) Applicant: Milbat—Giving Quality to Life, Tel-HaShomer, Ramat-Gan (IL)

(72) Inventors: Nachman Plotnizky, Ramat-Gan (IL); Harel Porat, Rishon-LeZion (IL)

(73) Assignee: Milbat—Giving Quality to Life, Tel-HaShomer, Ramat-Gan (IL)

( * ) Notice: Subject to any disclaimer, the term of this patent is extended or adjusted under 35 U.S.C. 154(b) by 145 days.

(21) Appl. No.: 13/941,501

(22) Filed: Jul. 14, 2013

(65) Prior Publication Data

US 2014/0035246 A1 Feb. 6, 2014

Related U.S. Application Data

(60) Provisional application No. 61/677,541, filed on Jul. 31, 2012.

(51) Int. Cl.

| | |
|---|---|
| ***A61G 5/12*** | (2006.01) |
| ***A61G 5/04*** | (2013.01) |
| ***A61H 1/02*** | (2006.01) |
| ***A63B 21/00*** | (2006.01) |
| ***A63B 21/02*** | (2006.01) |
| ***A63B 22/20*** | (2006.01) |
| ***A63B 23/035*** | (2006.01) |

(Continued)

(52) U.S. Cl.

CPC ..... *A61G 5/12* (2013.01); *A61G 5/047* (2013.01); *A61H 1/024* (2013.01); *A63B 21/0004* (2013.01); *A63B 21/023* (2013.01); *A63B 21/4033* (2015.10); *A63B 21/4034* (2015.10); *A63B 22/20* (2013.01); *A63B 23/03525* (2013.01); *A63B 23/03541* (2013.01); *A63B 23/0494* (2013.01); *A63B 71/0009* (2013.01); *A61G 2005/128* (2013.01); *A61G 2203/12* (2013.01); *A61G 2203/723* (2013.01); *A61H 2201/1276* (2013.01); *A61H 2201/1642* (2013.01); *A61H 2203/0431* (2013.01); *A63B 21/012* (2013.01); *A63B 2022/0094* (2013.01); *A63B 2071/0018* (2013.01); *A63B 2210/02* (2013.01); *A63B 2210/50* (2013.01); *A63B 2220/17* (2013.01); *A63B 2220/20* (2013.01)

(58) Field of Classification Search

CPC ..... A61G 5/10; A61G 2005/128; A61G 2005/1054; A61G 5/00; A61G 5/14; A61G 5/04; A61G 5/12; A61G 13/0018

USPC ..... 280/87.01

See application file for complete search history.

(56) References Cited

U.S. PATENT DOCUMENTS

| | | | |
|---|---|---|---|
| 740,071 | A | 9/1903 | Allen |
| 1,382,883 | A | 6/1921 | Ashbridge |

(Continued)

FOREIGN PATENT DOCUMENTS

| | | |
|---|---|---|
| EP | 1994966 | 11/2008 |

*Primary Examiner* — John Walters
*Assistant Examiner* — James Triggs

(57) ABSTRACT

A rolling footrest is provided and a method of using such by a wheelchair occupant. The footrest may optionally include a foot retainer, a platform and freely rolling castors. In some embodiments, replacing a fixed footrest will shorten the length of the wheelchair enabling the wheelchair to traverse sharp curves. In some embodiments, the footrest may include a swivel lock and/or a ratchet. In some embodiments the footrest may be used for therapeutic exercise. In some embodiments, the footrest may be used for propelling a wheelchair.

24 Claims, 12 Drawing Sheets

(51) Int. Cl.

| | |
|---|---|
| ***A63B 71/00*** | (2006.01) |
| ***A63B 23/04*** | (2006.01) |
| *A63B 21/012* | (2006.01) |
| *A63B 22/00* | (2006.01) |

(56) References Cited

U.S. PATENT DOCUMENTS

| | | | | |
|---|---|---|---|---|
| 3,640,566 | A | 2/1972 | Hodge | |
| 3,672,670 | A * | 6/1972 | Burzenski | A63B 22/20 192/12 R |
| 3,833,256 | A | 9/1974 | Dehner | |
| 4,484,755 | A | 11/1984 | Houston | |
| 5,301,970 | A | 4/1994 | Haskins | |
| 5,380,021 | A | 1/1995 | Doherty | |
| 5,427,391 | A | 6/1995 | Cooper | |
| 5,451,068 | A * | 9/1995 | Shockley | B25H 5/00 280/32.6 |
| 5,725,224 | A | 3/1998 | Kerr | |
| 5,870,774 | A | 2/1999 | Legenstein | |
| 5,937,440 | A | 8/1999 | Ferriter | |
| 6,053,189 | A | 4/2000 | Longenecker et al. | |
| 6,142,914 | A | 11/2000 | Crawford et al. | |
| 6,219,845 | B1 | 4/2001 | Ferriter | |
| 6,607,246 | B1 | 8/2003 | Benden | |
| 6,643,869 | B1 * | 11/2003 | Sloan, Jr. | A61G 7/10 280/304.1 |
| 6,948,777 | B2 * | 9/2005 | Marshall | A47C 7/52 297/423.2 |
| 6,955,400 | B2 | 10/2005 | Bellvis Castillo | |
| 7,197,770 | B1 | 4/2007 | Warren | |
| 7,426,970 | B2 | 9/2008 | Olsen | |
| 7,484,742 | B2 | 2/2009 | Choi | |
| D600,932 | S * | 9/2009 | Tierney | D6/367 |
| 7,611,447 | B2 | 11/2009 | Sarma | |
| 7,681,248 | B2 | 3/2010 | Legenstein | |
| 7,922,187 | B2 | 4/2011 | Fremgen | |
| 7,980,572 | B2 | 7/2011 | Bennett | |
| 8,262,548 | B1 * | 9/2012 | Morrow | 482/112 |
| 2004/0094915 | A1 | 5/2004 | Warren | |
| 2006/0172862 | A1 | 8/2006 | Badarneh et al. | |
| 2006/0237922 | A1 * | 10/2006 | Forbis | 280/32.6 |
| 2008/0251554 | A1 * | 10/2008 | Hassett | A44B 19/262 224/407 |
| 2010/0164201 | A1 | 7/2010 | Hochberg et al. | |
| 2010/0222180 | A1 * | 9/2010 | Takizawa | A61H 1/024 482/8 |
| 2010/0289230 | A1 | 11/2010 | Duarte et al. | |
| 2011/0121535 | A1 | 5/2011 | Fremgen et al. | |
| 2014/0265234 | A1 * | 9/2014 | Beck et al. | 280/291 |

* cited by examiner

720
A
716a
759
756
764a
764c
754
755
764b
716b
716c 720
716a
A'
766a
764c
764a
754
716b 720
766a
766b
764a
764b
756
755
754
764c
759
716b
716c
716a
7D 716a
764c
760
760
759
762
758
716a

WHEELCHAIR FOOT SUPPORT

RELATED APPLICATION

This application claims the benefit of priority under 35 USC §119(e) of U.S. Provisional Patent Application No. 61/677,541 filed Jul. 31, 2012, the contents of which are incorporated herein by reference in their entirety.

FIELD AND BACKGROUND OF THE INVENTION

The present invention, in some embodiments thereof, relates to a device and method to improve mobility of a handicapped individual and, more particularly, but not exclusively, to a rolling footrest adapted for use by a wheelchair occupant.

U.S. Pat. No. 3,833,256 to Dehner discloses an apparatus comprising a folding footrest which may be permanently mounted to a wheelchair. It folds with the chair between an open supportive position and a closed storage position. The footrest is mounted to the wheelchair frame in such a manner that it may be moved longitudinally with respect to the chair to Protrude forwardly of the chair while in use or be retracted within the chair frame for greater maneuverability in close quarters for compactness in storage or for better fitting to the best position of the feet of the invalid The footrest is operative at all times for the patient.

U.S. Pat. No. 5,937,440 discloses a wheeled support for supporting a kneeling person including a pair of knee supports each having a frame, a pad mounted on the frame, and three wheel assemblies mounted on a bottom of the frame. Also included is a pair of wheeled foot supports.

U.S. Pat. No. 740,071 to Allen provides a rest for the foot or a seat which when not supporting the weight of the foot or person will be on casters so as to be readily moved on the floor but when supporting said weight will bear as to the whole or a part directly on the floor without the intervention of casters so that it will not be easily or inconveniently movable on the floor.

U.S. Pat. No. 5,380,021 to Doherty discloses a sheet material sling supported on a horseshoe-shaped device mounted on three casters which forms a vehicle to support a knee of a user. Two such supports are used, unconnected to each other by users who must kneel in their work and must scoot along a support surface. Provisions are made for the supports to be interconnected by a flexible connector or by a rigid table like sheet.

U.S. Pat. No. 4,484,755 discloses a cart having a basket and wheeled metal chassis and adapted for use by handicapped, invalid and frail persons.

U.S. Pat. No. 7,980,572 to Bennett discloses an amputee mobility device includes a wheeled frame, and seat with webbed pocket for receiving an amputated leg.

Additional background art includes U.S. Publication No. 2011/0121535; U.S. Publication No. 2010/0289230; U.S. Publication No. 2010/0164201; U.S. Publication No. 2006/0172862; U.S. Publication No. 2004/0094915; U.S. Pat. No. 7,922,187; U.S. Pat. No. 7,681,248; U.S. Pat. No. 7,611,447; U.S. Pat. No. 7,484,742; U.S. Pat. No. 7,426,970; U.S. Pat. No. 7,197,770; U.S. Pat. No. 6,955,400; U.S. Pat. No. 6,607,246; U.S. Pat. No. 6,219,845; U.S. Pat. No. 6,142,914; U.S. Pat. No. 6,053,189; U.S. Pat. No. 5,870,774; U.S. Pat. No. 5,725,224; U.S. Pat. No. 5,427,391; U.S. Pat. No. 5,301,970; U.S. Pat. No. 3,833,256; U.S. Pat. No. 3,640,566; and U.S. Pat. No. 1,382,883.

SUMMARY OF THE INVENTION

The present invention, in some embodiments thereof, relates to a device and method to improve mobility of a handicapped individual and, more particularly, but not exclusively, to a rolling footrest adapted for use by a wheelchair occupant.

According to an aspect of some embodiments of the present invention there is provided a footrest for a physically limited subject. The footrest may include a platform for supporting the bottom of a foot of the subject. The platform may be sized to fit between the front wheels of a wheelchair. An omni-directional rolling base may hold the platform supporting the foot above a surface. The base may roll in any direction along a surface while supporting the foot.

According to some embodiments of the invention, the footrest may further include a foot retainer connected to the platform.

According to some embodiments of the invention, a hanger may be included for stowing the footrest on the wheelchair.

According to some embodiments of the invention, the foot retainer may include a slip on shoe.

According to some embodiments of the invention, the foot retainer may be reversibly connected to the platform.

According to some embodiments of the invention, the platform may be between 5 cm and 15 cm above the surface.

According to some embodiments of the invention, the footrest may further include an adjuster for adjusting the height of the platform.

According to some embodiments of the invention, the footrest may further include a safety brake stopping the rolling when a weight on the footrest is greater than a threshold.

According to some embodiments of the invention, the footrest may further include a safety brake stopping the rolling when a weight on the footrest is less than a threshold.

According to some embodiments of the invention, the footrest may further include a lock restricting the rolling in at least one direction.

According to some embodiments of the invention, the lock may include a swivel lock.

According to some embodiments of the invention, the footrest may further include a ratchet restricting rolling to a particular direction.

According to some embodiments of the invention, the footrest may further include a detachable tether tying the footrest to a wheelchair.

According to some embodiments of the invention, the tether may be elastic, to return the footrest to a fixed position relative to the wheelchair in an unstressed state.

According to some embodiments of the invention, the footrest may further include a detachable wheelchair for supporting the subject.

According to some embodiments of the invention, the footrest may further include a fastener for connecting the footrest to another footrest.

According to an aspect of some embodiments of the present invention there is provided a method of adjusting a wheelchair and a wheelchair bound subject seated therein for maneuvering in a narrow space. The method may include supporting a foot of the wheelchair bound subject on an omni-directional rolling support, and rolling the wheelchair and the omni-directional rolling support separately to traverse the narrow space.

According to some embodiments of the invention, the method may further include removing the foot from a wheelchair mounted footrest prior to the supporting.

According to some embodiments of the invention, the method may further include stowing the wheelchair mounted footrest.

According to some embodiments of the invention, the method may further include adjusting a height of the omni-directional rolling support.

According to some embodiments of the invention, the adjusting may be to a height between 5 and 15 cm.

According to some embodiments of the invention, the method may further include limiting movement of the omni-directional rolling support in an excluded direction.

According to some embodiments of the invention, the method may further include rolling the omni-directional rolling support in a rolling direction, and propelling the wheelchair with a force on the omni-directional rolling support in the excluded direction.

According to some embodiments of the invention, the method may further include restricting movement of the footrest to a region in front of the wheelchair.

According to some embodiments of the invention, the method may further include attaching the omni-directional rolling support to the wheelchair.

According to an aspect of some embodiments of the present invention there is provided a method of exercising for a wheelchair bound subject, the method may include supplying a rolling footrest. The footrest may include a platform for supporting the bottom of a foot of the subject the platform sized to fit between the front wheels of a wheelchair, and an omni-directional rolling base holding the platform and supporting the foot. The base may roll in any direction along a surface while supporting the foot. The method may further include setting the rolling footrest to permit at least a portion of a safe range of movement for the subject. The method may further include setting the rolling footrest to inhibit at least a portion of a dangerous range of movement for the subject. The method may further include supporting a foot of the subject on the platform, and rolling the footrest by the subject to perform a therapeutic exercise regime.

According to some embodiments of the invention, the method may further include taking the rolling footrest from its stowed position on the wheelchair.

According to some embodiments of the invention, the method may further include determining the safe range of motion for the subject.

According to some embodiments of the invention, the method may further include determining the dangerous range of motion for the subject.

According to an aspect of some embodiments of the present invention there is provided a method of propelling a wheelchair. The method may include setting a rolling footrest to permit rolling in a preferred direction. The method may further include setting the rolling footrest to limit rolling in a non-preferred direction. The method may further include supporting a foot of the subject on the rolling footrest, and alternatively extending and retracting of the legs of a wheelchair user thereby alternatively rolling the wheelchair and the rolling footrest in a preferred direction.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1A:
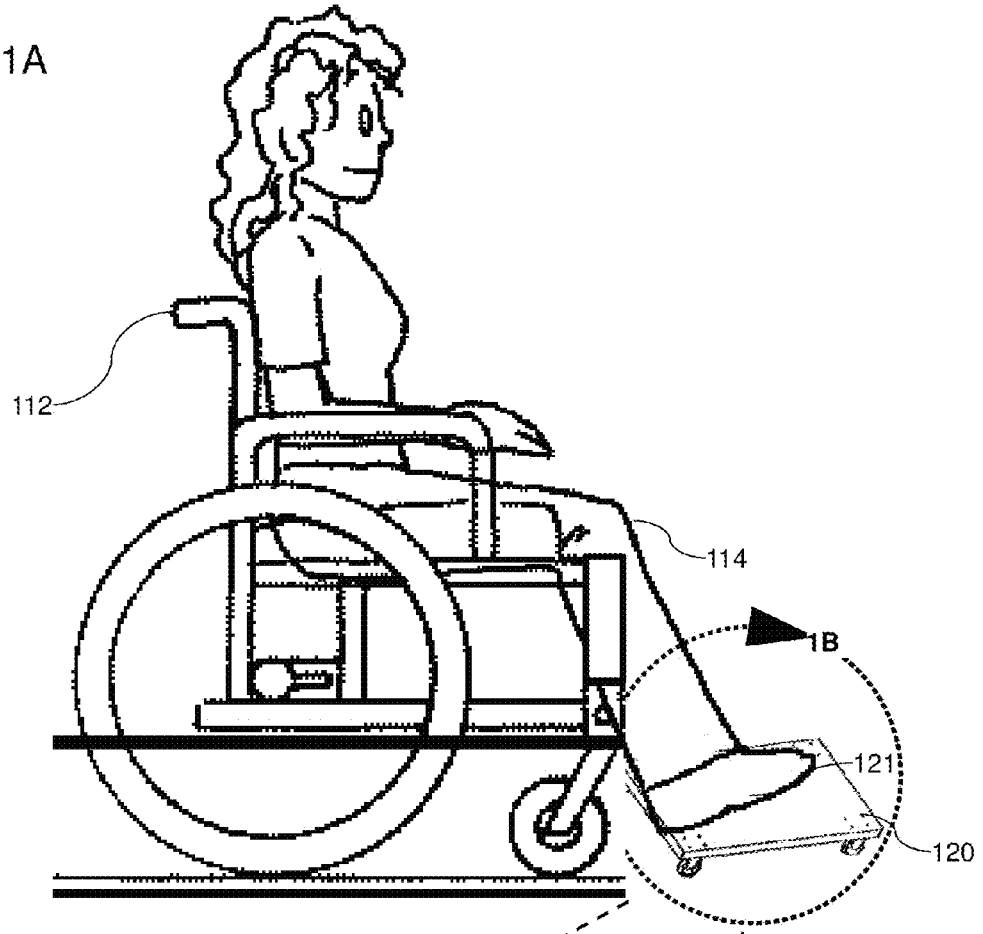
FIG. 1A is a schematic drawing of a handicapped person using an exemplary embodiment of a pair of rolling footrests.

The present invention, in some embodiments thereof, relates to a device and method to improve mobility of a handicapped individual and, more particularly, but not exclusively, to a rolling footrest adapted for use by a wheelchair occupant.

Overview of Exemplary Embodiments

Independent Rolling Footrest

An aspect of the current invention is related to an omni-directional rolling footrest having a foot retainer. In some embodiments, the footrest may be used by an occupant of a wheelchair.

In some embodiments, use of a rolling footrest may reduce the length of a wheelchair in comparison to use of a wheelchair mounted footrest. In some instances reducing the length of the wheelchair may increase maneuverability in tight spaces.

In some embodiments, a rolling footrest may support a foot of the wheelchair occupant at a height of for example between 4 and 20 cm above a floor. Optionally the height of the footrest may be adjustable.

In some embodiments adjustment of the footrest (for example the height, the swivel lock of the casters and/or the direction of movement of the wheels) may be made manually. Manual adjustments may optionally be made by a wheelchair occupant if he is not too limited. Manual adjustments may optionally be made by a caretaker. Alternatively, or additionally a rolling footrest may include a servo. The servo may optionally be controlled by a remote control unit. A wheelchair occupant may optionally use the remote control unit to adjust the footrest. In some embodiments, where there are dual footrests there may be two remote control units, one for each footrest. Alternatively and/or additionally, there may be a single remote control unit to control both footrests.

Optionally the length of the footrest may be, for example, between 15 cm and 40 cm and the width may be, for example, between 10 cm and 20 cm for a single foot footrest and the width may be, for example, between 15 cm and 40 cm for a two foot footrest. Thus the footrest may fit between the wheels of the wheelchair.

In some embodiments the foot retainer may include a slip on shoe, for example a Crocs™ and/or a slipper.

Maneuvering in Tight Spaces

An aspect of the current invention is related to a method of maneuvering a wheelchair and its occupant in a tight space. In some embodiments, a foot of the occupant may be supported by a rolling footrest. Optionally the wheelchair and the footrest may be maneuvered separately in the tight space. For example, the length of the wheelchair and occupant may be reduced by moving the footrest toward the wheelchair and/or a tight turn may be traversed by allowing the footrest with the occupant's legs to move laterally with respect to the wheelchair.

In some embodiments, the height of the footrest may be adjusted according to the relative location of the footrest and the wheelchair. For example, when the footrest is brought up close to the wheelchair, the height of the footrest may be reduced to make more room for the legs of the user.

Exercise for Handicapped Subject

An aspect of the current invention is related to a method of therapeutic exercise for an occupant of a wheelchair.

In some embodiments, a safe range of movement for the wheelchair occupant will be determined. Optionally a therapeutic exercise regime will be defined. Optionally, the wheels of the foot rest will be set to allow the safe range of movement. Optionally, the wheels of the foot rest will be set to prevent unsafe movements. Optionally, a foot of the occupant may be supported by the appropriately adjusted footrest while the occupant performs the exercise regime to roll the footrest over a surface. Optionally the occupant's legs may be secured to the footrest. Optionally the footrest may include a measuring device (for example a counter, or a device to measure the distance rolled) to track movements.

For example, for an occupant with a weak knee that may be injured by sideways forces, the footrest may be limited to forward/backward movement. Optionally, the occupant may safely exercise his knee while sitting still or will rolling in the wheelchair.

In some embodiments the exercise may include moving the wheelchair. For example, the wheels of the footrest may be prevented from rolling in one direction (for example by means of a ratchet). For example, when the wheels of the footrest are allowed to roll only in the forward direction, then when the occupant extends his foot forward, the footrest will roll forward, but when the occupant draws his foot back, the ratchet will prevent the foot rest from rolling and the wheelchair will be pulled forward. For example, such a geometry may contribute to the mobility of a stroke patient who has limited mobility in one leg and lacks strength in his arms or hands.

As used herein, the term wheelchair can refer to various kinds of invalid chairs including for example a manually propelled wheelchair, a reclining wheelchair, a transport chair, and a self propelled wheelchair.

Exemplary Embodiments

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Dual Four Castered Footrests

Figure 1B:
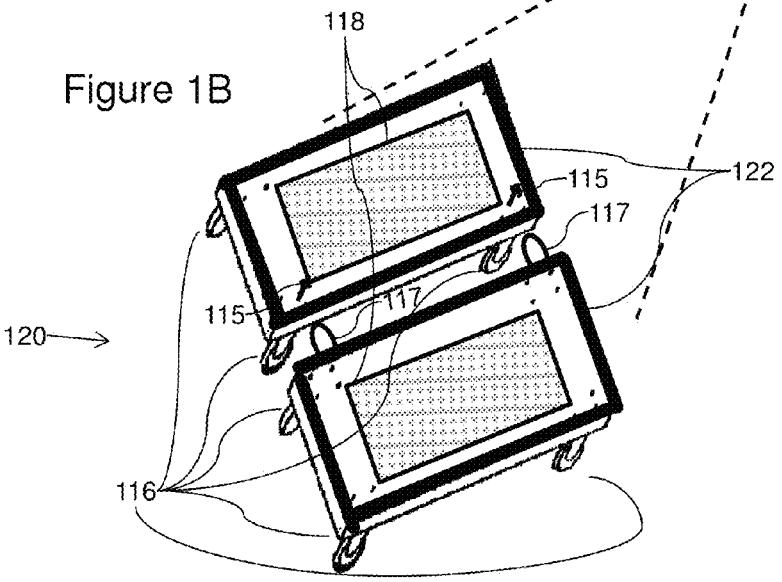
FIG. 1B is a close up schematic drawing of the embodiment of the rolling footrests of FIG. 1A.

Referring now to the drawings, FIGS. 1A and 1B are schematic illustrations of a user 114 of a wheelchair 112. User 114 is employing an exemplary embodiment of a pair of wheeled footrests 120. Optionally wheeled footrests 120 may supply support for the feet of user 114 in a way that allows flexibility in the geometry of the wheelchair-occupant-footrest arrangement. In some embodiments this flexibility may be of advantage, for example, when maneuvering in tight quarters. This flexibility may also allow user 114 to perform therapeutic movements of her legs.

In some embodiments footrests 120 roll on swivel lock casters 116. Casters 116 may optionally permit omni-directional rolling (in any direction). Casters 116 may optionally be swivel locked to permit rolling in one direction (for example only backward and forward or only from side to side). For example, locking casters 116 to roll only backward and forward may be useful to allow therapeutic and safe back and forth motion for a patient having weak knees which may be damaged by sideways strain.

In some embodiments, a footrest may include an omni-wheel, for example in place of one or more of castors 116.

In some embodiments, a rolling footrest may include a foot retainer. For example the feet of user 114 are retained on footrests 120 by means of Velcro™ 118. User 114 may optionally wear a house-shoe 121 having a Velcro™ strip on the bottom of the sole. The Velcro™ strip of house-shoe 121 may attach to Velcro™ 118 when using footrest 120. Optionally, Velcro™ 118 may be mounted on padding. The padding may help prevent pressure sores on the bottom of the feet of user 114.

In some embodiments, footrests 120 may include bumpers 122. Optionally bumpers 122 may help avoid damaging of walls or furniture contacting footrests 120. Optionally, bumpers 122 may protect user 114 or her assistant from bruises or cuts resulting from a blow against footrests 120.

In some embodiments, bumpers 122 may include a sensor. For example, the sensor may warn the user when footrest 120 contacts a wall or another object. The warning may include for example a buzzer and/or a light which may be mounted to footrest 120 and/or send wirelessly to a light and/or buzzer mounted on wheelchair 112. Alternatively or additionally, a signal may be sent wirelessly to a mobile phone (for example via Bluetooth) of user 114 or a caretaker. Thus, the footrest may optionally alert the user (for example a visually impaired user) of the presence of an obstacle and/or the footrest may optionally alert a caretaker when the user is stuck.

In some embodiments a pair of footrests 120 may include a connector. For example footrests 120 include two optional pegs 115 on the left footrest 120 and two optional elastic loops 117 on the right footrest. Optionally, loops 117 can be hooked onto respective pegs 115 to join the two single footrests 120 into one large footrest for supporting both feet together. Alternatively and/or additionally various sorts of fasteners may be used to connect two footrests together. For examples, connecters may include a bar, a hook, a clasp, Velcro™ etc.

A Method of Maneuvering in a Narrow Space

Figure 2:
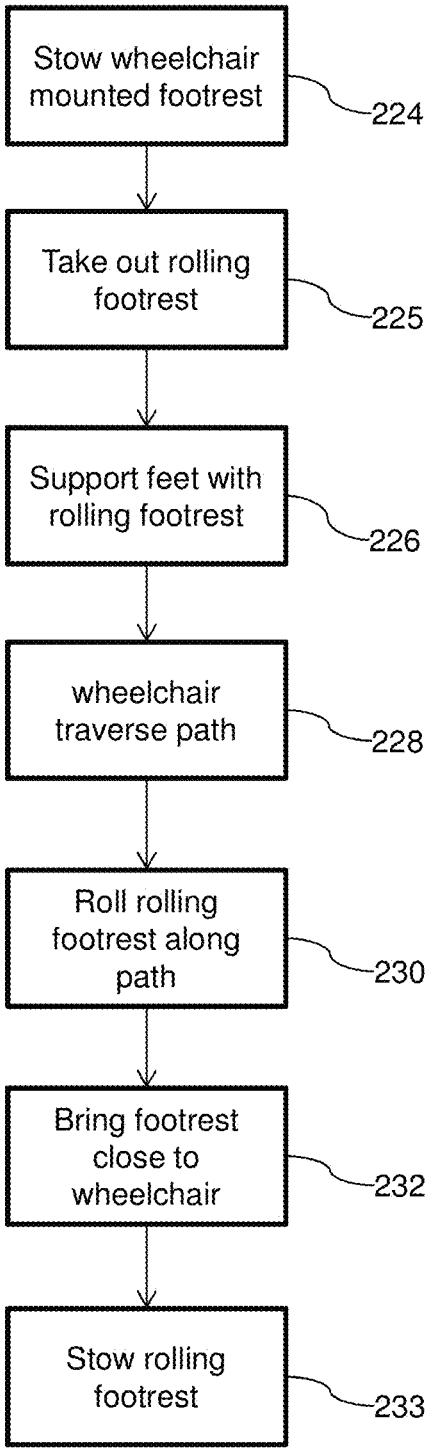
FIG. 2 is a flowchart illustrating an exemplary method of maneuvering a wheelchair in a narrow space.

FIG. 2 is a flow chart of an exemplary method of maneuvering a wheelchair in a narrow space. In some embodiments, the feet of a wheelchair occupant will be removed from a wheelchair mounted footrest and the wheelchair mounted footrest will be stowed 224 (for example folded up and/or removed from the wheelchair). In some cases, removing the footrests may shorten the length of the wheelchair. After removing the footrest, it may sometimes be easier to maneuver in tight spaces.

In some embodiments, a rolling footrest may be taken out 225 (for example the rolling footrest may removed from a bag or from a hook). A foot of the wheelchair occupant may optionally be supported 226 on a rolling footrest. This may optionally shorten the wheelchair. Optionally, the shortened wheelchair can traverse 228 the path while the footrest rolls 230 separately. For example, when traversing 228 a sharp turn the footrest and the user's feet may be displaced laterally with respect to the wheelchair. This may optionally decrease the turning radius to the entire wheelchair-occupant-footrest arrangement, allowing the three to "snake" along the thin path. Optionally, the feet of the user may be brought 232 up close to the wheelchair. In some cases this may shorten the length of the wheelchair-occupant-footrest arrangement.

In some embodiments, when a foot of the occupant is brought 232 closer to the wheelchair, the footrest may be lowered and/or the wheelchair may be raised. This may make more space for the occupant's leg.

In some embodiments, a rolling footrest may prevent the foot of the occupant from dragging on the floor. Optionally, the footrest may protect the foot of the user from blows from obstacles along the path. Optionally the rolling footrest may raise up the feet of the occupant (for example, to improve blood circulation).

After use the rolling footrest may be optionally stowed 233. The wheelchair mounted footrest may optionally be replaced. The feet of the user may be optionally be returned to the wheelchair mounted footrest.

Figure 3:
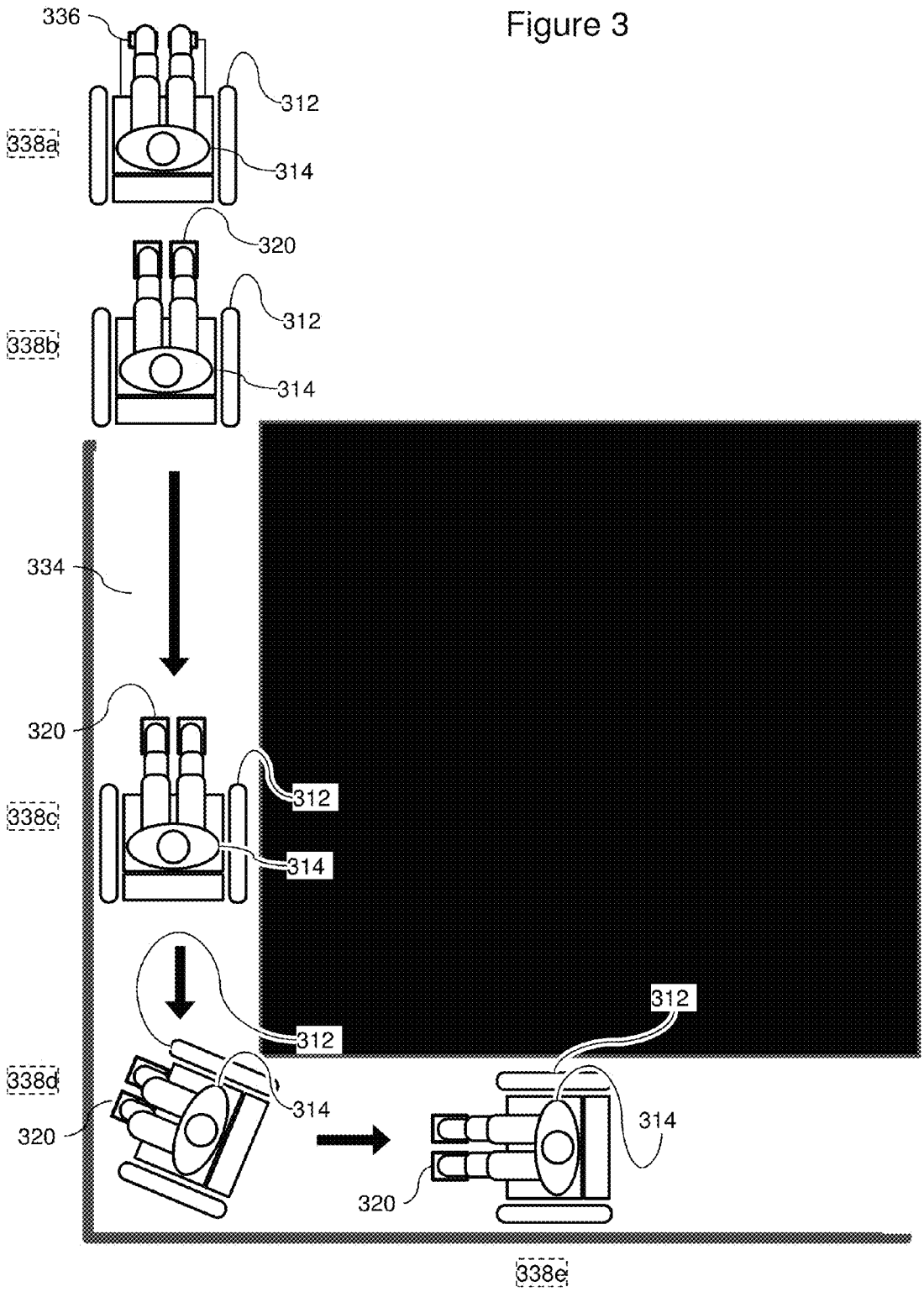
FIG. 3 is a schematic illustration of an exemplary method of maneuvering a wheelchair in a narrow space.

FIG. 3 is a schematic illustration of a method of maneuvering a wheelchair on a narrow path. The figure depicts a user 314 in a wheelchair 312. Before starting to traverse a narrow path 334 the user and/or his helper stows a wheelchair mounted footrest 336. The user's 314 feet are then supported on a pair of rolling footrests 320.

In some embodiments, wheelchair 312 and footrests 320 may roll separately along the narrow path 334.

For example, wheelchair 312 and footrests 320 change their relative positions as they snake along path 334 from position 338*a* to position 338*b* to position 338*c* to position 338*d* position 338*e*. For example, at position 338*d* as the wheelchair backs around a tight corner, user 314 moves footrests 320 inward (between the front wheels of wheelchair 312) and rightward with respect to wheelchair 312.

A Method of Therapeutic Exercise

Figure 4:
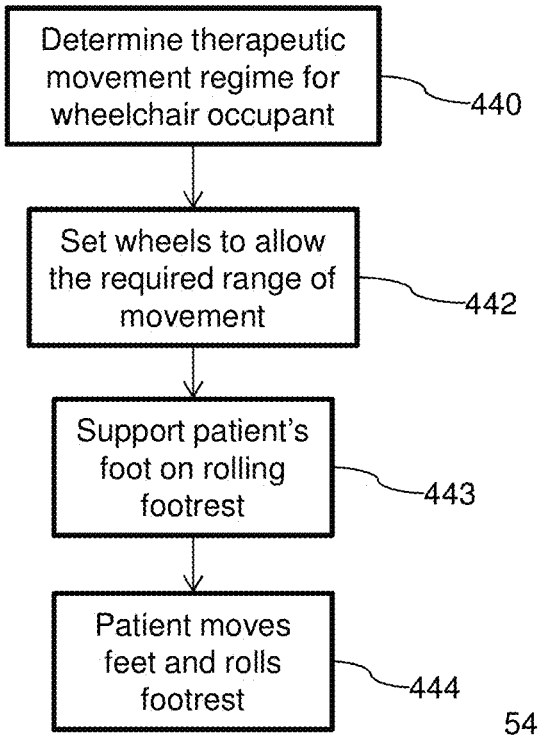
FIG. 4 is a flowchart illustrating an exemplary method of therapeutic exercise for a wheelchair occupant.

FIG. 4 is a flowchart illustration of an exemplary method of therapeutic exercise employing a rolling footrest for a person having limited movement. In some embodiments, the user may exercise his legs by moving his feet while supported on the rolling footrest. In some cases a person having temporary and/or permanent limitation of strength and/or movement of his legs may find it necessary to support his feet. Rigid foot supports supplied on many wheelchairs may prevent movement of the person's legs. Lack of movement may sometimes lead to atrophy and/or loss of circulation. Optionally, a wheeling footrest may be used to support a user's foot, while allowing movement in a preferred direction. The user may then exercise his leg by moving his feet in the preferred direction.

In some embodiments, a caretaker will determine 440 a range of permissible therapeutic movements for a patient. For example, for some patients it may be permissible to move their foot in any direction along the floor. In such a case a caretaker may determine that the user may move his foot in any direction along the floor. In another example, a user may have a weak knee and sideways movement may be potentially damaging. In that case, the caretaker may determine 440 an exercise regime including only forward and backward movement.

Figure 6A:
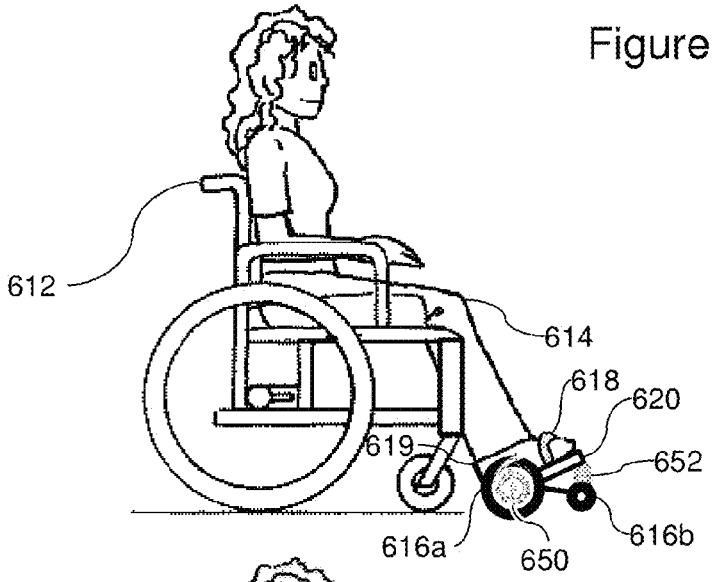
FIG. 6A is a schematic drawing of an exemplary step in a method of propelling a wheelchair employing a wheeled footrest.
Figure 6B:
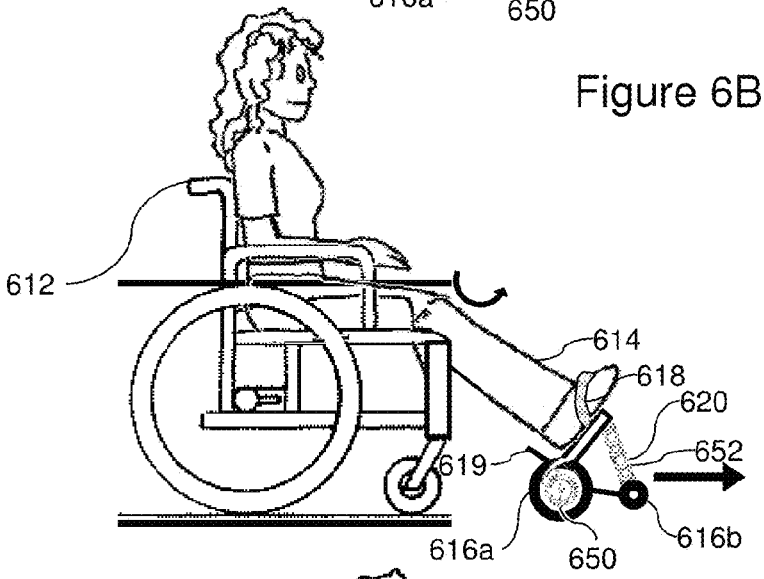
FIG. 6B is a schematic drawing of an exemplary second next in the method of propelling a wheelchair employing a wheeled footrest.
Figure 6C:
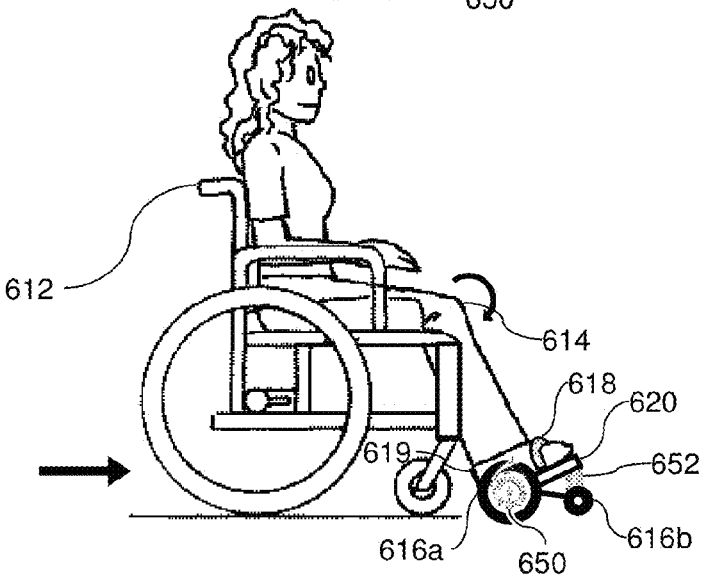
FIG. 6C is a schematic drawing of an exemplary next step in the method of propelling a wheelchair employing a wheeled footrest.

In some embodiments, a caretaker and/or the user may set 442 the wheels of the rolling footrest to allow a therapeutic movement and to prevent a dangerous movement. For example, when a user is permitted movement in all directions, casters of a rolling footrest may be adjusted to roll and swivel freely. In another example, when a user is allowed only backward and forward movement, the swivel locks of casters of a rolling footrest may be set 442 to permit only backward and forward movement. Optionally the height of the footrest may be adjusted according to the exercise regime. Optionally, a surface of the footrest may be set 442 to move in accordance with the movements of the user. For example, the height and angle of the top of the footrest may change as the footrest is pushed forward and backward, for example as illustrated in FIGS. 6A, 6B and 6C.

In some embodiments, once the rolling footrest has been properly adjusted, the user may support 443 his foot on the footrest. Optionally, the user's feet may be secured to the footrest, for example by means of a Velcro™ and/or a strap and/or a slip on shoe mounted to the footrest. The user may perform the prescribed exercise by rolling 444 the footrest in a prescribed direction. Optionally, the movements of the footrest may be recorded to supply feedback. For example feedback may be used to monitor compliance with an exercise regime and/or to provide feedback as to improvement and/or degeneration of the user's condition and/or to supply encouragement to the user to continue the exercise. Optionally, resistance to movement may be supplied. For example the user may push the footrest on a resistant surface (for example a carpet or sand and/or a bumpy mat) and/or a wheel of the footrest may have an adjustable friction resistance.

In some embodiments, exercise will be performed with the wheelchair stationary. For example, before the exercise the wheels of the wheelchair may be locked. Alternatively or additionally, the exercise may be performed while the user is traveling. For example, while an assistant is pushing the wheelchair, the user can be moving his feet back and forth.

Propelling a Wheelchair

In some embodiments, a user with limited movement of at least one leg may be afforded a degree of self mobility by supplying rolling footrest that rolls in a preferential direction. By very simple movements, the user may be able to propel himself and the wheelchair. For example many stroke victims have a limited ability to move one or more of their limbs. Optionally, the method may offer such people an opportunity for self mobility using the limited powers that they have. In some cases, the exercise and the feeling of (albeit limited) control of one's own body and/or life can be of immense therapeutic value.

Figure 5:
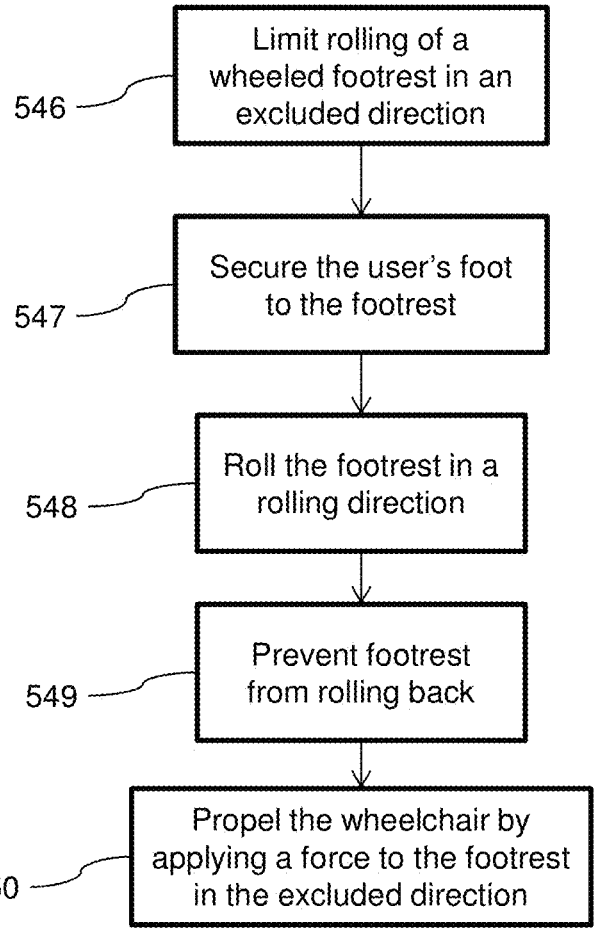
FIG. 5 is a flowchart illustrating an exemplary method of propelling a wheelchair.

FIG. 5 is a flowchart illustration of an exemplary method of propelling a wheelchair using a rolling footrest. In some embodiments, the rolling of the footrest may be limited 546 to a preferred direction. For example, one or more wheels of the footrest may include a ratchet and/or a swivel lock allowing rolling only in a forward direction.

In some embodiments, the user's foot may be secured 547 to a footrest.

In the example of FIG. 5, the user optionally rolls 548 the footrest forward while the wheelchair remains steady (for example due to the greater friction and/or inertia of the wheelchair compared to the footrest, and/or due to the user holding the wheels of the wheelchair to prevent them from moving).

In some embodiments, when the user pulls back his foot, the footrest is prevented 549 from returning in the non-preferred direction. Thus, optionally when the user returns his foot, the footrest remains steady and the wheelchair is propelled 550 forward.

For example, a footrest may be prevented from returning via a ratchet and swivel lock (as illustrated for example of FIGS. 6A-6C). Using the wheeled footrest, the user may be able to propel 550 the wheelchair via a simple back and forth movement of his foot. For example the user may not need to raise or lower his foot, and/or may not need to control sideward movement of his foot.

FIGS. 6A, 6B and 6C illustrate schematically an exemplary embodiment of a method for propelling a wheelchair employing a wheeled footrest. In the example, an occupant 614 of a wheelchair 612 employs a footrest 620 to propel herself forward. Footrest 620 includes an optional ratchet 650. In the illustrative example, when wheelchair occupant 614 extends her legs forward (for example as depicted in FIG. 6B) ratchet 650 allows footrest 620 to roll forward while wheelchair 612 remains stationary. Subsequently, when wheelchair occupant 614 optionally draws her legs back (for example as illustrated in FIG. 6C), ratchet 650 optionally does not allow wheel 616*a* to rotate. As illustrated for example in FIG. 6C, footrest 620 optionally remains stationary and wheelchair 612 is propelled (pulled) forward.

In some embodiments, a rolling footrest may include a strap 618 and back plate 619. Optionally, strap 618 and back plate 619 may retain the foot of wheelchair occupant 614 on footrest 620.

Optionally wheels 616*a* and 616*b* may be casters with optional swivel locks or brakes. Alternatively or additionally, wheels 616*a* may be fixed on an axle while wheels 616*b* may be casters. Optionally, brakes and swivel locks of casters and/or wheels (for example wheels 616*a,b*) may be linked. For example, a single lever may lock multiple casters.

In some embodiments the height or angle of the top platform the footrest may have an adjustable pivot and/or have an adjustable height. For example, in FIGS. 6A-C, the platform of footrest 620 pivots around the axle of wheels 616*a*. A spring assembly 652 keeps the platform in contact with the bottoms the feet of wheelchair occupant 614. Optionally the angle of pivoting of the platform may be limited. For example, the platform of footrest 620 may pivot between parallel to the supporting surface and 60 degrees to the supporting surface.

Further Exemplary Embodiments of a Rolling Footrest

FIGS. 7A-D illustrate an exemplary embodiment 720 of a rolling footrest. Various optional features illustrated in FIGS. 7A-D include an optional omni-directional swivel locking caster assembly 754, a self braking rear wheel assembly 716*a* and an adjustable height/tilt platform 756.

Optionally exemplary embodiment 720 includes three wheels 716*a,b,c*. Rear wheel 716*a* is optionally a self braking fixed axel wheel while wheels 716*b* and 716*c* are optionally casters.

Figures 7A, 7B, 7C, 7D:
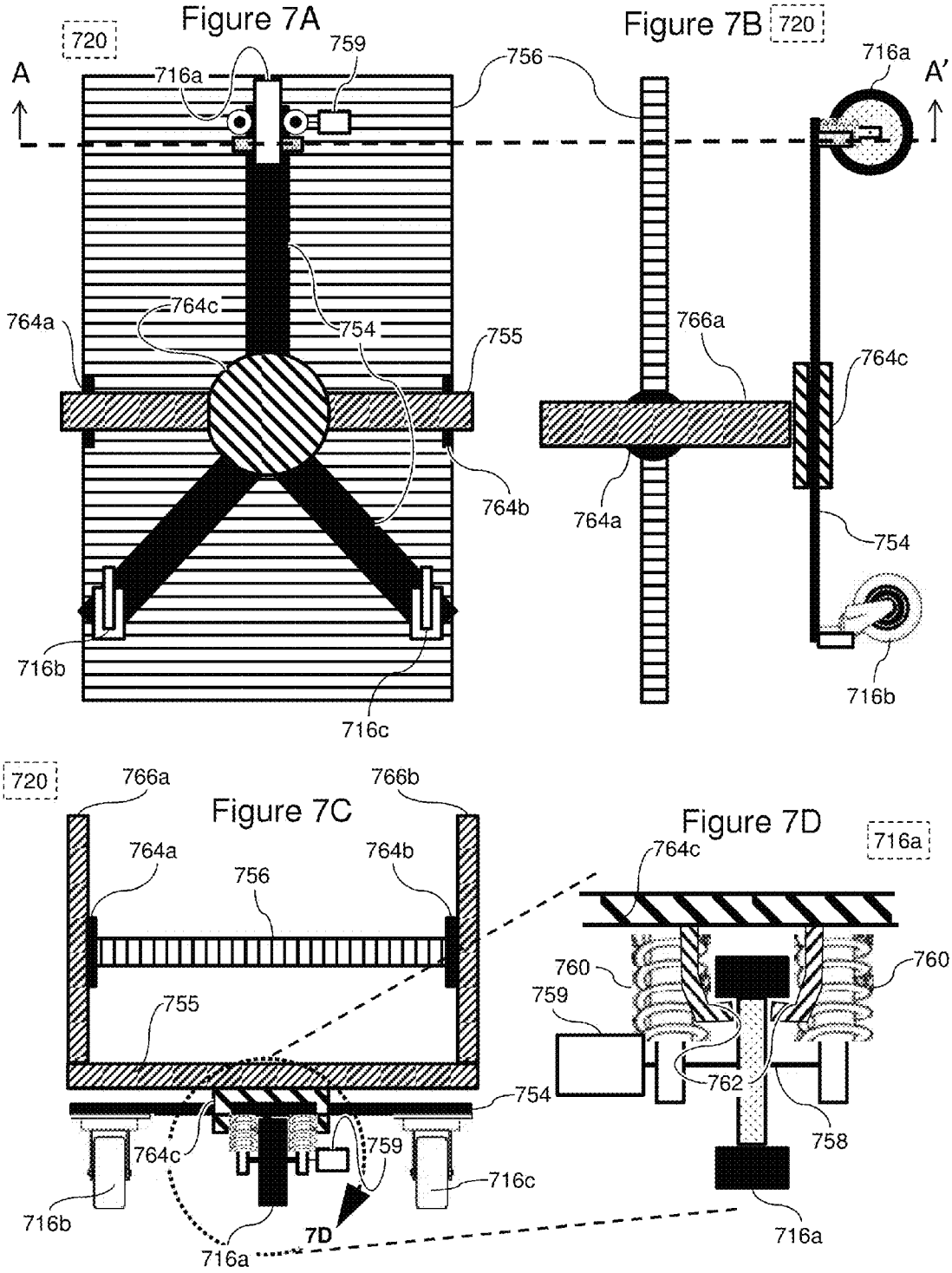
FIG. 7A is a bottom view of an exemplary embodiment of a wheeled footrest.
FIG. 7B is a left side view of an exemplary embodiment of a wheeled footrest.
FIG. 7C is a rear view of an exemplary embodiment of a wheeled footrest.
FIG. 7D is an expanded front view of a rear wheel of an exemplary embodiment of a wheeled footrest.

FIG. 7A shows a bottom view of the exemplary embodiment 720. An optional platform 756 is provided to which a user's foot may be secured. Optionally platform 756 is mounted on pivots 764*a* and 764*b*. Optionally, pivots 764*a,b* allow adjustment of the angle of platform 756. Optionally, pivots 764*a,b* are slidably mounted on vertical supports 766*a* and 766*b*. In exemplary embodiment 720, pivots 764*a,b* slide up or down on supports 766*a,b* to adjust the height of platform 756.

In some embodiments, platform 756 may swivel with respect to caster assembly 754. For example, in embodiment 720, supports 766*a,b* are mounted to caster assembly 754 using a pivot 764*c* and cross bar 755. In exemplary embodiment 720, the casters (wheels 716*b,c*) and pivot 764*c* include swivel locks. When wheels 716*b,c* and pivot 764*c* are locked, then the footrest will tend to roll back and forth along a single direction (along a single line).

FIG. 7D is an expanded cutaway view of circle 7D of FIG. 7C (cut along line A-A') illustrating an exemplary locking mechanism of wheel 716*a*. Optionally, an axel 758 of wheel 716*a* is mounted on springs 760. Optionally, when there the weight on footrest 720 is less than a minimum threshold, springs 760 push downward until the an inner edge of wheel 716*a* contacts brake pads 762. Thus, optionally, when there is no weight on footrest 720 it is automatically braked. Optionally, self-braking may prevent the footrest from rolling away from a limited mobility user, for example when he takes his feet off the footrest.

In some embodiments, some and/or all functions of a rolling footrest may be controlled using a remote control. For example, in embodiment 720, an actuator may optionally be built into pivots 764*a,b*. Optionally, the actuator may raise lower and/or rotate platform 756. Alternatively or additionally, a servo may be built into pivot 764*c* to control the direction of platform 756 and/or the locking of wheels 716*a,b*. Alternatively or additionally, a remote controlled motor 759 may be supplied to propel the footrest. In this way a handicapped user may be able to optionally adjust and/or retrieve the footrest by himself.

Figure 8:
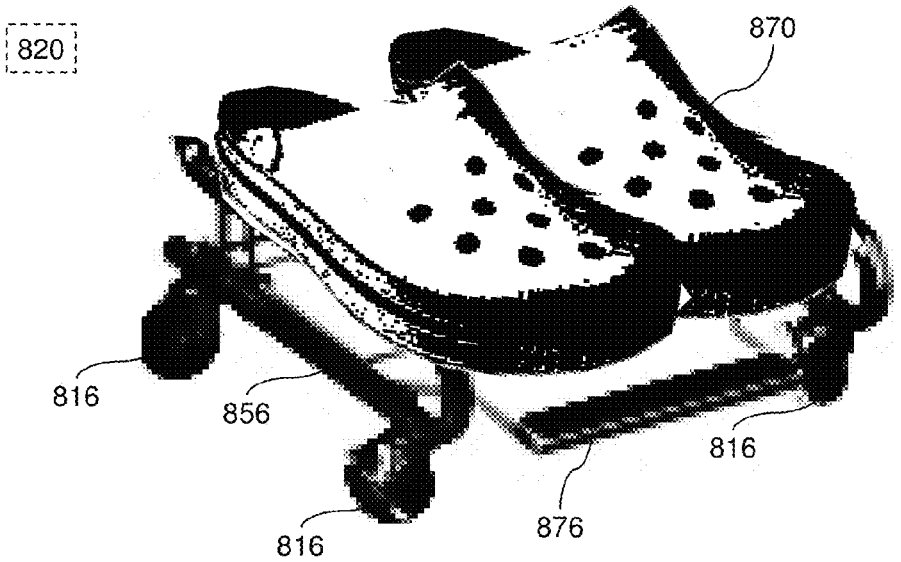
FIG. 8 illustrates another exemplary embodiment of a rolling footrest.

FIG. 8 illustrates another exemplary alternative embodiment 820 of a rolling footrest with a lever 876 for simultaneously swivel locking castors 816. Optionally, lever 876 may swivel lock some (for example the front 2) of castors 816. Alternatively or additionally, lever 876 may swivel lock all of castors 816. In some embodiments a braking lever may also be supplied.

Optionally, embodiment 820 includes slip on shoes 870 to secure a user's foot to the footrest. Shoes 870 are optionally fixed to a wireframe platform 856. The entire assembly rolls on castors 816. Optionally, a single footrest may support both feet of the user.

Figure 9:
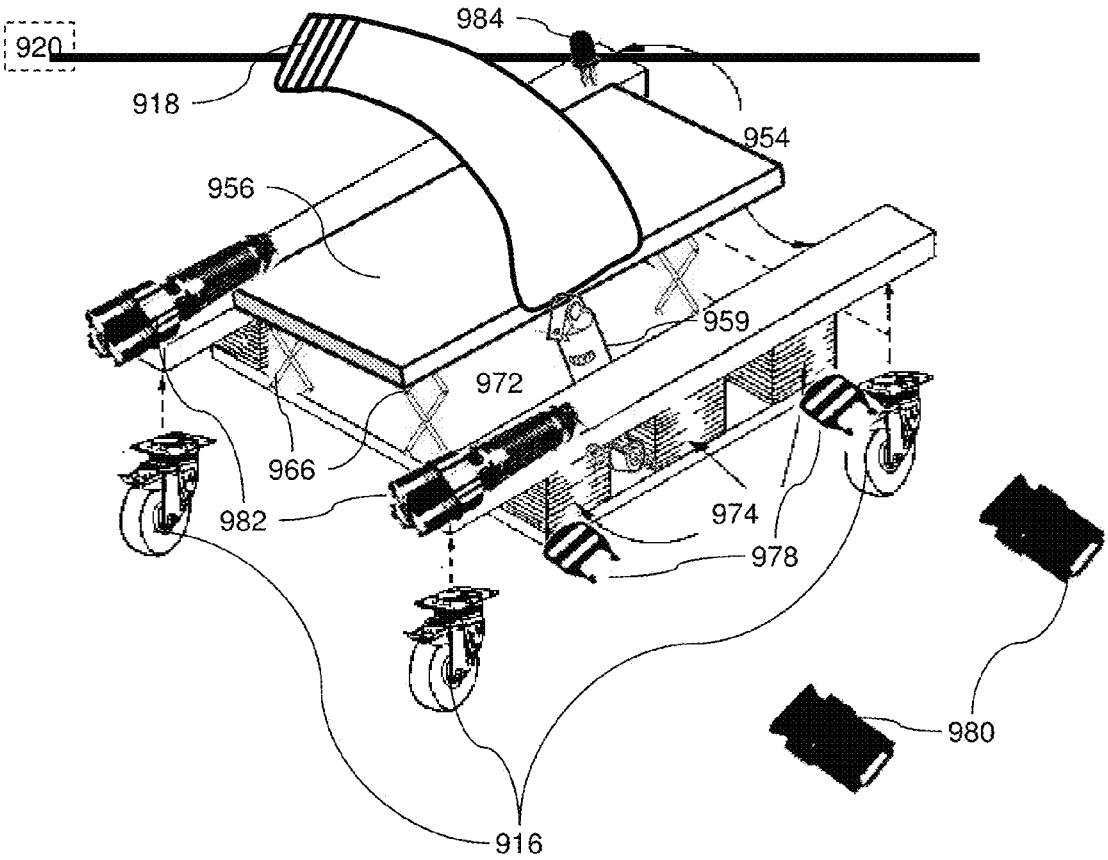
FIG. 9 illustrates another exemplary embodiment of a rolling footrest.

FIG. 9 illustrates another exemplary embodiment 920 with an optional adjustable height platform 956. The form of embodiment 920 allows lowering platform 956 (and the user's feet) very close to the floor (within 2 centimeters of the floor) during use.

In some embodiments platform 956 may be attached to a lower deck 972 by vertically expandable scissors supports 966. Optionally deck 972 may be supported between the wheels of castors 916 on spacers 974. Spacers 974 may optionally be supported on castors 916 by a support assembly 954. Optionally deck 956 includes a strap 918. Strap 918 may optionally be used to secure the footrest to a foot of a user.

In some embodiments, a pair of footrests may be connectable. For example, embodiment 920 includes two male quick release connectors 978. Optionally, connectors 978 can be connected to matching female connectors 980 to attach the footrest to a second footrest (not shown). Attaching two footrests may optionally support both of a user's feet together. Alternatively or additionally footrests may be connected by a rigid connecter, for example a metal plate and receptacle on the bottom two respective footrests.

In some embodiments, a footrest may include lights. Optionally lights may include an indicator 984 to make it easier for a visually impaired user to find the footrest. Lights may also include headlamps 982.

In some embodiments the height of a footrest may be controlled remotely. For example, footrest 920 may optionally include a remotely controlled hydraulic cylinder 959 to raise and/or lower platform 956.

Tethers

In some embodiments a rolling footrest may include a tether. A tether may optionally be used to connect a rolling footrest to the wheelchair (for example a front wheel, or a front frame member) to a rolling footrest (for example, embodiment 120, 320, 620, 720, 820, and/or 920). A tether may optionally restrict movement of the footrest to within a certain distance of the wheelchair or to a region in front of the wheelchair. Optionally, the tether may include a quick release.

Figure 10A:
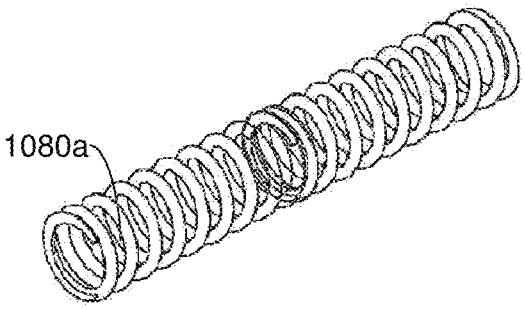
FIG. 10A illustrates an embodiment of a tether.

FIG. 10A illustrates an exemplary tether 1080*a*. Tether 1080*a* includes, for example, a spring. For example, tether 1080*a* may optionally allow footrest to be moved relative to the wheelchair. When no stress is applied to the footrest, tether 1080*a* may optionally bring the footrest back to a determined distance from the wheelchair.

Figure 10B:
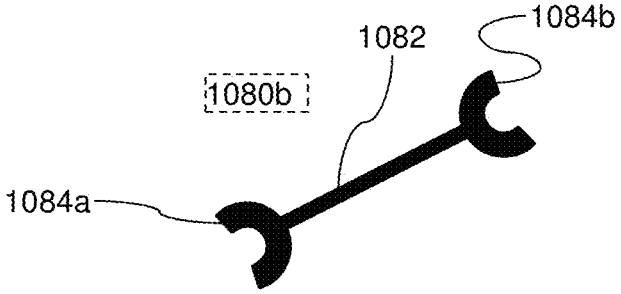
FIG. 10B illustrates another embodiment of a tether.

FIG. 10B illustrates another exemplary tether 1080*b*. Tether 1080*b* includes, for example, a stiffly flexible plastic shaft 1082 and rigid connectors 1084*a* and 1084*b*. For example, tether 1080*a* may optionally allow footrest to be moved relative to the wheelchair. When no stress is applied to the footrest, tether 1080*b* may optionally bring the footrest back to a determined location relative to the wheelchair. Tether 1080B may optionally restrict movement of the footrest to a region in front of the wheelchair. For example, the footrest may be prevented from straying more than 30 cm to either side.

Figure 10C:
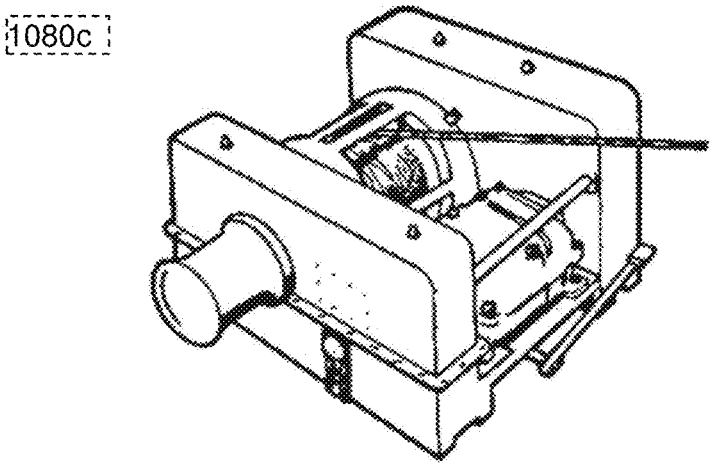
FIG. 10C illustrates an embodiment of a remote control winch tether.

Alternatively or additionally, as illustrated for example in FIG. 10C, a tether may include a self winding cord or a cord with a remote control winch, for example winch 1080C. Optionally self winding may permit easy stowing on the wheelchair and/or on the footrest. Optionally, self winding may prevent the cord from dragging on the floor when the wheelchair is being used with the footrest close to the wheelchair. Remote control winch 1080C may permit the wheelchair user to control the distance between the footrest and wheelchair to prevent his feet from being dragged too far away from the chair. Remote control winch 1080C may also enable a disabled user to easily retrieve the footrest.

Remote Controls

Figure 11A:
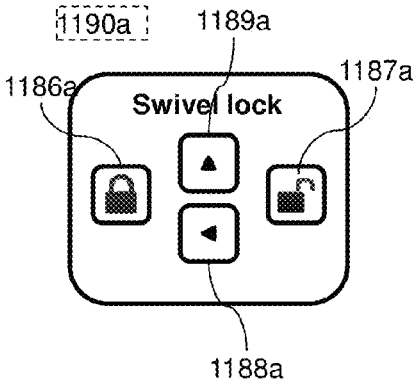
FIG. 11A illustrates an embodiment of a remote control unit.
Figure 11B:
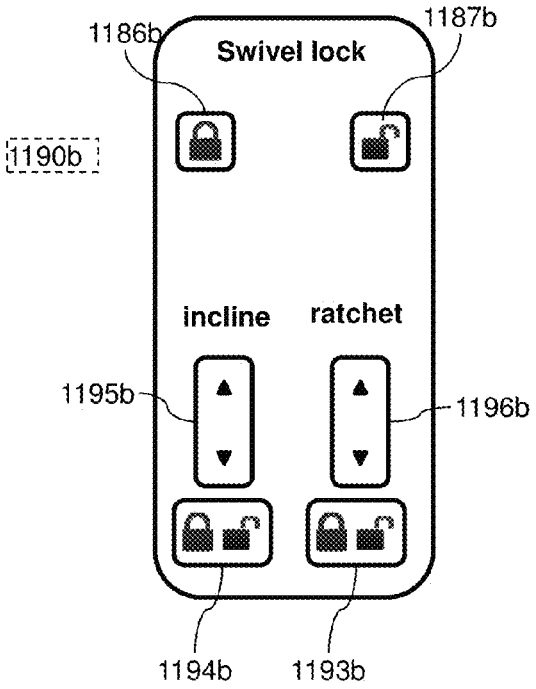
FIG. 11B illustrates another embodiment of a remote control unit.
Figure 11C:
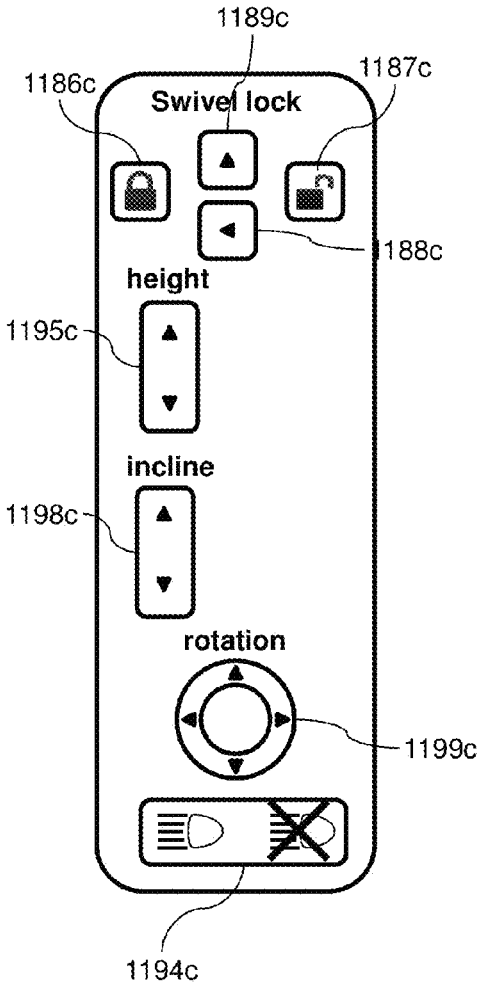
FIG. 11C illustrates another embodiment of a remote control unit.

FIGS. 11A, 11B and 11C illustrate alternative embodiments of remote control units for a mobile footrest. A mobile footrest may optionally include servos to control various aspects of the footrest. The mobile footrest may optionally include a remote control unit enabling a handicapped individual to adjust the settings of a mobile footrest. Alternatively or additionally, a footrest may be adjusted manually either by the handicapped user or by an assistant.

In the case of dual footrests, there may optionally be dual remote control units (for example one unit mounted on each hand rest or a wheelchair). Alternatively or additionally, there may be a single unit that can toggle to control the left or right footrest (for example in a manner similar to mirror controls in some cars). Alternatively or additionally, a single remote control unit may have two sets of controls (for example one set of controls for one footrest and another set of controls for the other footrest).

In some cases, a footrest may include a motor. Optionally the user may be able to retrieve the footrest by remote control and/or the footrest may serve the user as a mobile platform, for example to send objects to someone in another room without having to go there.

FIG. 11A illustrates an example of a remote control unit 1190*a* for controlling the swivel locks of the casters of a wheeled footrest. Any of the embodiments listed above can include (for example embodiment 120, embodiment 620, embodiment 720, embodiment 820, embodiment 920) may include a servo controlling the swivel locks controlled by remote control unit of FIG. 11A. A remote control unit may include various control switches for example, a button, a knob, a joystick, a keypad, a multi-way key, a switch etc. For example, unit 1190*a* includes button 1186*a* which locks the swivel locks, button 1187*a* which unlocks the swivel locks, button 1188*a* which directs the casters laterally and button 1189*a* which directs the casters longitudinally.

FIG. 11B shows an alternative remote control unit 1190*b* that may be used for example with embodiment 620. For example, unit 1190*b* includes button 1186*b* which locks the swivel locks of caster wheels 616*b*, button 1187*b* which unlocks the swivel locks. The direction of the wheels can be adjusted by the user before locking them.

Unit 1190*b* also includes optional controls for the incline of the platform of footrest 620. A toggle switch 1194*b* controls whether the incline is locked or unlocked. For example, when the incline is locked, the incline is controlled by unit 1190*b*. For example when locked, the incline may be raised or lowered using a 2 way button 1195*b*. For example, when the incline is unlocked, the user may freely control the incline with his/her feet (for example as illustrated of FIGS. 6A-6C).

Unit 1190*b* also includes optional controls for ratchet 650 of the platform of 620. A toggle switch 1194*b* controls whether ratchet 650 is locked (for example allowing movement in only one direction) or unlocked (for example allowing back and forth movement). Optionally, when the ratchet 650 is locked, then a 2 way button 1196*b* controls whether ratchet 650 allows forward movement only or backward movement only. Alternatively or additionally, a ratchet may only lock in only one direction. Optionally, when there is a one-directional ratchet, remote control unit 1190*b* may not include two-way switch 1196*b*.

FIG. 11C shows an alternative remote control unit 1190*c* that may be used for example with embodiment 720. For example, unit 1190*c* includes button 1186*c* which locks the swivel locks of caster wheels 716*b,c*, a button 1187*c* which unlocks the swivel locks, a button 1188*c* which directs the casters laterally and a button 1189*c* which directs the casters longitudinally.

Unit 1190*c* also includes optional controls for the incline of platform 756. In the case of embodiment 720 the incline may optionally always be locked (controlled by unit 1190*c*). For example the incline of platform 756 may be raised or lowered using a 2 way button 1198*c*.

Unit 1190*c* also includes optional controls for the height of platform 756. For example, platform 756 may be raised or lowered using a 2 way button 1195*c*.

Unit 1190*c* may optionally include a multi-way switch 1199*c*. For example switch 1199*c* may control the angle of rotation of pivot 764*c*. Unit 1120*c* may also include an optional toggle switch 1194*c* for turning on and off lights (for example headlights similar to headlights 982 of embodiment 920).

Alternative to Casters

Figure 12A:
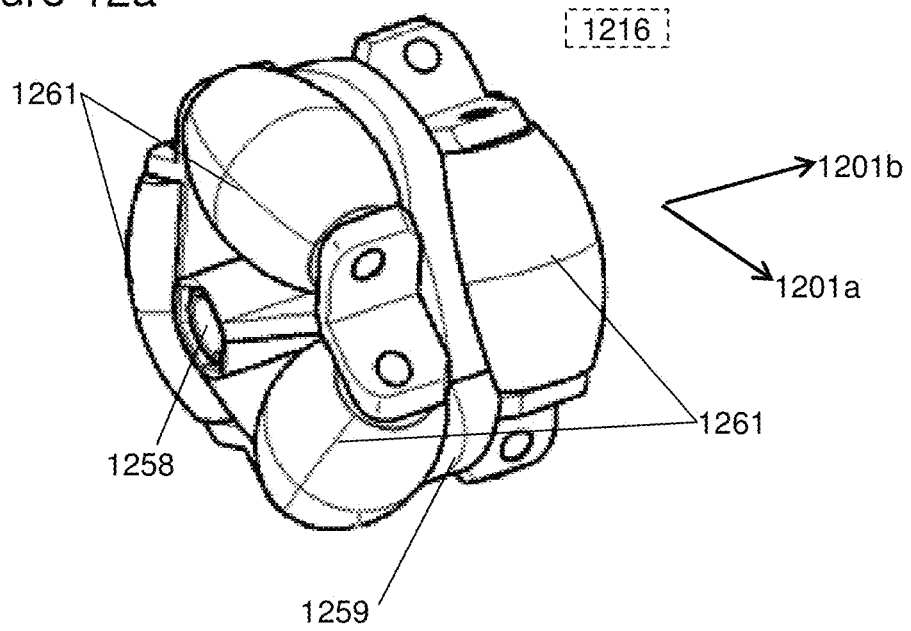
FIG. 12A illustrates an example of an omni-wheel.

Optionally, in some embodiments (for example 120, 320, 620, 720, 820, 920), casters (for example 116, 616*b*, 716*b*, 716*c*, 816, 916) may be replaced by an alternative roller (for example omni-wheel 1216 of FIG. 12*a*). Omni-wheel 1216 may optionally be adjusted to restrict movement in one direction while permitting free movement in another direction.

Rotation around the axis 1258 of Omni-wheel 1216 allows movement in the longitudinal direction 1201*a*. Rotation of rollers 1261 allows movement in the lateral direction 1201*b*. This allows separate control of movement in a longitudinal direction 1201*a* lateral direction 1201*b*. For example movement in the longitudinal direction may optionally be controlled by a servo motor, for example servo motor 1259 built into wheel 1216.

Figure 12B:
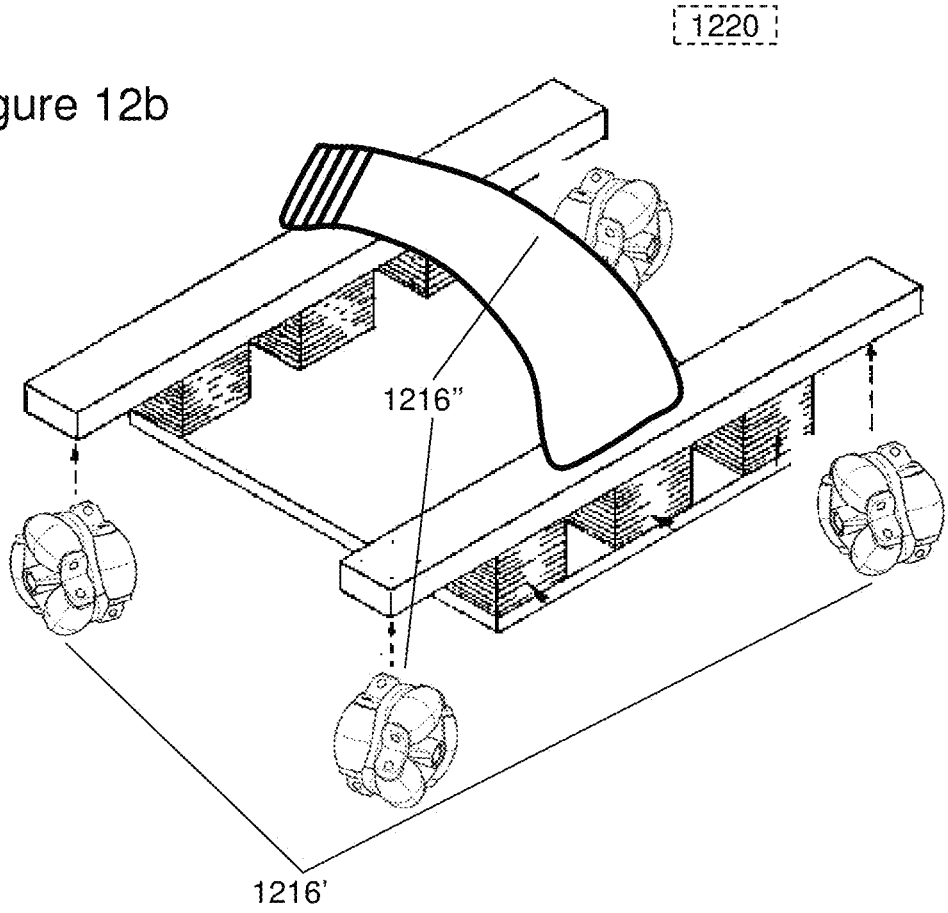
FIG. 12B illustrates an embodiment of an omni-wheeled footrest.

FIG. 12*b* illustrates an example of use of omni-wheel 1216 to propel a footrest 1220. On footrest 1220 opposite omni-wheels 1216" are optionally mounted longitudinally with respect to footrest 1220 and adjacent omni-wheels 1216' are optionally mounted laterally with respect to footrest 1220. Driving laterally mounted omni-wheels 1216' causes footrest 1220 to move sideways. Driving omni-wheels 1216" drives footrest 1220 forward and/or backward. Driving one of omni-wheels 1216" forward and the other one backward causes footrest 1220 to rotate.

There are many optional control modes for footrest 1220. For example, footrest 1220 may be controlled by remote control. Footrest 1220 may include a sensor, sensitive to the location of the wheelchair or the user. The footrest may include a processor programmed to drive omni-wheels 1216' and 1216" to keep a certain relative position with respect to the wheelchair (for example to remain centered in front of the wheelchair). Alternatively and/or additionally, rollers of longitudinal omni-wheels 1216" may optionally have a return spring to allow restricted limited lateral movement. For example, a spring may tend to return the footrest to a region in front of the wheelchair. For example, the rollers may optionally be limited to a few revolutions, restricting lateral movement of the footrest to within a region of about 30 cm. Limiting lateral movement of the footrest may keep the footrest in front of the wheelchair.

Remote Controlled Swivel Lock Casters

Figure 13A:
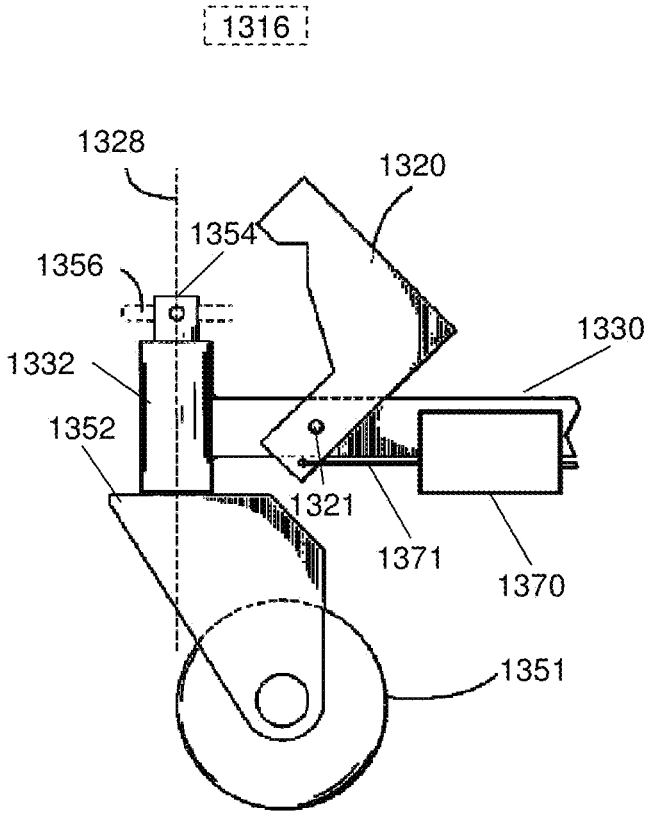
FIG. 13A illustrates an embodiment of a castor with a remote controlled swivel lock in an unlocked configuration.
Figure 13B:
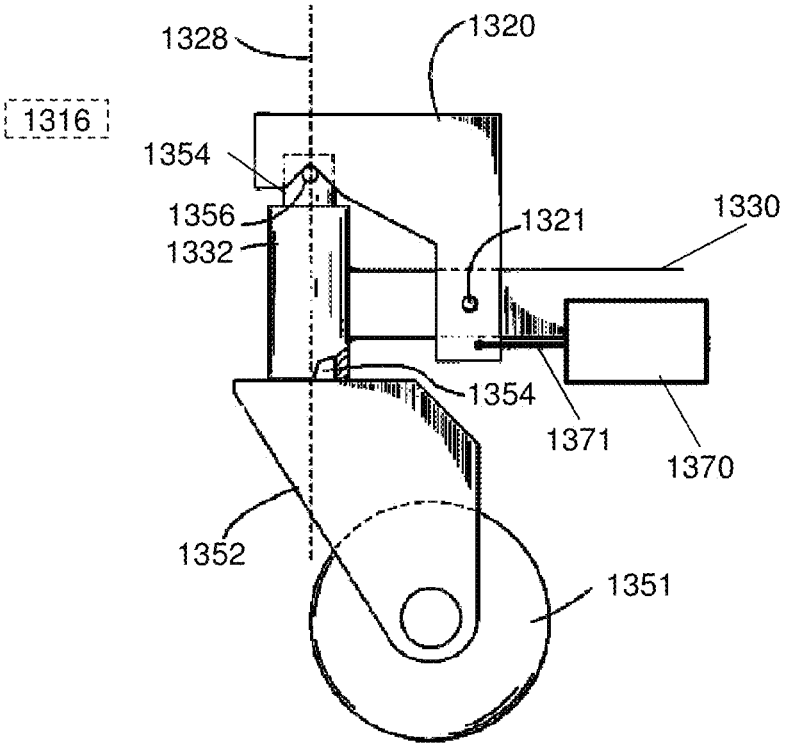
FIG. 13B illustrates an embodiment of a castor with a remote controlled swivel lock in a locked configuration.

FIGS. 13A and 13B illustrates an exemplary embodiment of a remote controlled swivel lock caster assembly 1316 is an unlocked and locked configuration respectively. Caster assembly 1316 may be included for example in casters 116, 616*b*, 716*b*, 8161*b*, 9161*b* and may be used with a remote control, for example, remote control unit 1190*b*. The swivel lock may be used for example to restrict rolling of the casters to a particular direction.

In some embodiments, assembly 1316 is configured to swivel about the swiveling axis 1328 relative to the frame 1330, and includes a wheel 1351, a wheel yoke 1352, a sleeve 1332 optionally welded to frame 1330, a swivel spindle 1354 and a locking pin 1356. Optionally, wheel 1351 is mounted for rotation within the yoke 1352 as is known in the art. Optionally, cylindrical swivel spindle 1354 is rigidly mounted to the top of yoke 1352 as is known in the art. Optionally, locking pin 1356 is rigidly attached to the top marginal end of the swivel spindle 1354 such that it forms a type of "T" at the top of spindle 1354. As may be understood, as spindle 1354 swivels about the swiveling axis 1328 relative to the frame 1330, so does the locking pin 1356 swivel. Optionally, when unlocked, spindle 1354 is free to swivel 360 degrees.

Locking pin 1356 is in some embodiments a roll pin, although other configurations are contemplated without departing from the spirit and scope of the present invention.

In some embodiments, a pivoting locking bracket 1320 is shaped in an inverted channel configuration, and defines two downwardly-oriented V-shaped notches which engage and contain locking pin 1356 in order to provide the locking function. Optionally, locking bracket 1320 is pivotally mounted to frame member 1330 along a substantially horizontal axis which is normal to the plane of paper of FIGS. 13A and 13B, by means of a pivot pin 1321.

In some embodiments, a remote controlled servo 1370 is used to control the pivoting motion of the pivoting locking bracket 1320. Optionally extension of a piston 1371 causes disengagement of pivoting locking bracket 1320 to the position shown in FIG. 13A, and retraction of piston 1371 causes engagement of the pivoting locking bracket 1320 to the position shown in FIG. 13B.

Suitable springs (not shown), including torsion springs, may optionally be used to provide the desired spring bias on pivoting locking bracket 1320, to assist in extension or retraction as desired. In some embodiments, the pivoting locking bracket 1320 is biased into its locked position by spring force.

Stowing a Footrest

FIGS. 14A-D illustrate a few optional ways of stowing a rolling footrest 1420 while not in use. When a user needs the footrest, (for example to navigate a tight space or to perform an exercise) the user optionally takes the footrest from its stowed position, places it on the floor and uses it. When the user is finished using the footrest, he optionally stows it again.

Figure 14A:
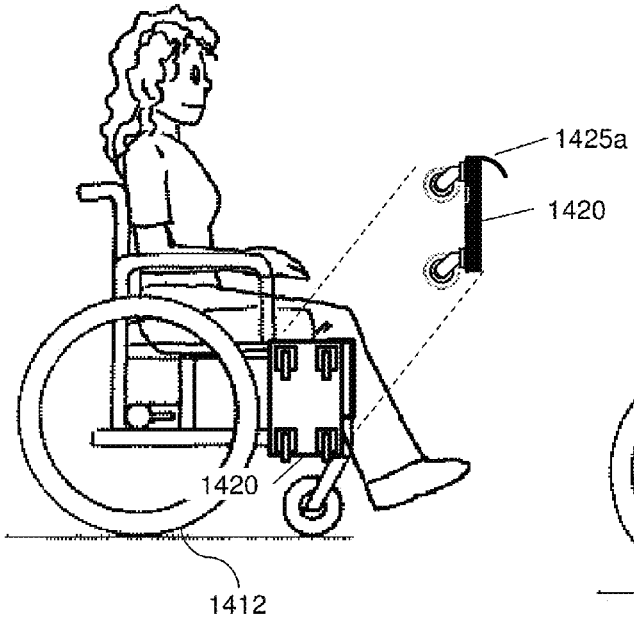
FIG. 14A illustrates an embodiment of a footrest having a hook for stowing on a wheelchair.

For example, FIG. 14A illustrates footrest 1420 with an optional hanger 1425*a*. Hanger 1425*a* includes a hook attached to footrest 1420 for hooking over a bar on a wheelchair 1412 thereby supporting footrest 1420 when not in use.

Figure 14B:
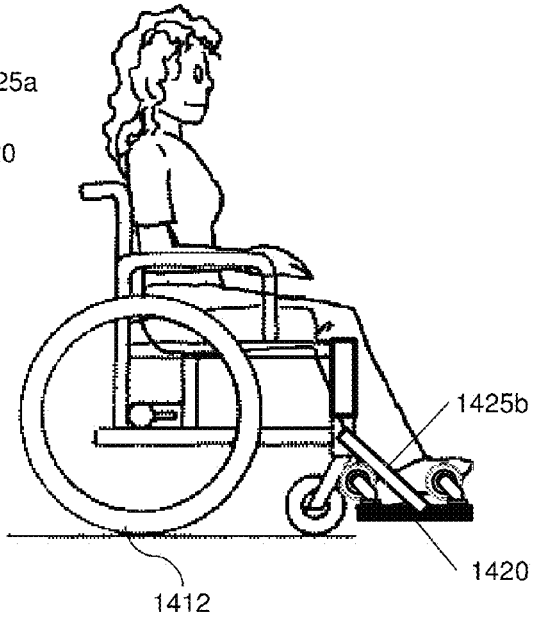
FIG. 14B illustrates an embodiment of a footrest configured for stowing on a wheelchair as a wheelchair mounted footrest.

Alternatively or additionally, FIG. 14B illustrates wheelchair 1412 with an optional hanger 1425*b*. Hanger 1425*b* is designed to hold footrest 1420 out in front of wheelchair 1412 as a wheelchair mounted footrest.

Figure 14C:
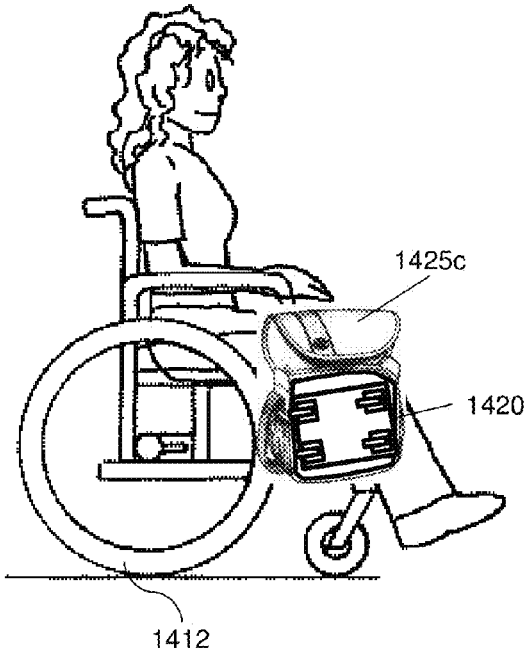
FIG. 14C illustrates an embodiment of a bag for hanging a footrest on a wheelchair.

Alternatively or additionally, FIG. 14C illustrates wheelchair 1412 with an optional hanger 1425*c*. Hanger 1425*c* includes a bag designed to hold footrest 1420 when not in use.

Figure 14D:
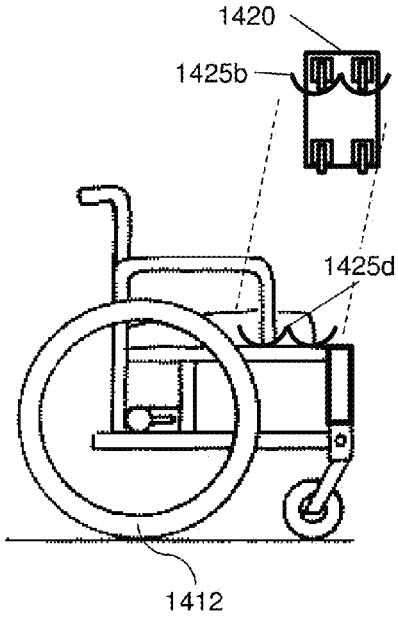
FIG. 14D illustrates an embodiment of wheelchair with a hook for hanging a footrest.

Alternatively or additionally, FIG. 14D illustrates wheelchair 1412 will an optional hanger 1425*d*. Hanger 1425*d* includes a hook fastened to wheelchair 1412 for holding footrest 1420 when not in use.

It is expected that during the life of a patent maturing from this application many relevant technologies will be developed and the scope of the terms is intended to include all such new technologies a priori.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

As used herein, the term "treating" includes abrogating, substantially inhibiting, slowing or reversing the progression of a condition, substantially ameliorating clinical or aesthetical symptoms of a condition or substantially preventing the appearance of clinical or aesthetical symptoms of a condition.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A footrest for a physically limited seated subject comprising:

a platform for supporting a bottom of a foot of the seated subject said platform sized to fit between front wheels of a wheelchair; and an omni-directional rolling base holding said platform between 5 to 15 cm above a surface, and wherein said base rolls in any direction along said surface while supporting said foot.

2. The footrest of claim 1, further comprising:

a foot retainer connected to said platform.

3. The footrest of claim 1, further comprising:

a hanger for stowing the footrest on said wheelchair.

4. The footrest of claim 1, further comprising:

an adjuster for adjusting the height of said platform.

5. The footrest of claim 1, further including:

a safety brake stopping the footrest from rolling when a weight on the footrest is greater than a threshold.

6. The footrest of claim 1, further comprising:

a safety brake stopping the footrest from rolling when a weight on the footrest is less than a threshold.

7. The footrest of claim 1, further comprising:

a lock restricting the footrest from rolling in at least one direction.

8. The footrest of claim 7, wherein said lock includes a swivel lock.

9. The footrest of claim 1, further comprising:

a ratchet restricting rolling to a particular direction.

10. The footrest of claim 1, further comprising:

a detachable tether tying the footrest to a wheelchair.

11. The footrest of claim 1, further comprising:

a detachable wheelchair for supporting the subject.

12. The footrest of claim 1, further comprising:

a fastener for connecting the footrest to another footrest.

13. The footrest of claim 4, wherein the height of said footrest is adjustable between 5 cm and 15 cm above said surface.

14. The footrest of claim 2, wherein said platform is sized and shaped to support the bottom of exactly one foot.

15. The footrest of claim 14, further comprising:

exactly one foot retainer sized and shaped to retain said exactly one foot.

16. The footrest of claim 2, wherein said platform includes exactly two foot retainers.

17. The footrest of claim 1, wherein said platform is shaped and sized to support a bottom of a single foot.

18. The footrest of claim 17, wherein a width of said platform is less than 20 cm.

19. The footrest of claim 1, further including:

a second footrest including a second platform for shaped and sized to support a bottom of a single foot, said second platform including a second omni-directional rolling base holding said second platform above said surface, and wherein said second base rolls in any direction along said surface while supporting said single foot, and a fastener for reversibly connecting said footrest to said second footrest for supporting said foot and said single foot together.

20. A footrest for a physically limited seated subject comprising:

a first platform shaped and sized to support a bottom of a single foot of the seated subject said first platform sized to fit between front wheels of a wheelchair; and a first omni-directional rolling base holding said platform above a surface, and wherein said first base rolls in any direction along said surface while supporting said single foot and wherein said first base holds said first footrest between 5 cm and 15 cm above said surface.

21. The footrest of claim 20, further including:

a retainer for said single foot.

22. The footrest of claim 20, wherein a width of said platform is less than 20 cm.

23. The footrest of claim 20, further including:

a second footrest including a second platform shaped and sized to support a bottom of another single foot, said second platform including a second omni-directional rolling base holding said second platform above said surface, and wherein said second base rolls in any direction along said surface while supporting said another foot, and a fastener for reversibly connecting said footrest to said second footrest for supporting said single foot and said another foot together.

24. The footrest of claim 20, wherein the height of said first base is adjustable to hold said first platform between 5 cm and 15 cm above said surface.

* * * * *